US011889873B2

(12) United States Patent
Williams

(10) Patent No.: US 11,889,873 B2
(45) Date of Patent: Feb. 6, 2024

(54) WEARABLE BLANKET WITH DISTRIBUTED WEIGHT SYSTEM

(71) Applicant: Dreamland Baby Co., Danville, CA (US)

(72) Inventor: Tara Williams, Danville, CA (US)

(73) Assignee: DREAMLAND BABY CO., Danville, CA (US)

( * ) Notice: Subject to any disclaimer, the term of this patent is extended or adjusted under 35 U.S.C. 154(b) by 433 days.

(21) Appl. No.: 16/664,941

(22) Filed: Oct. 27, 2019

(65) Prior Publication Data

US 2020/0196685 A1 Jun. 25, 2020

Related U.S. Application Data

(60) Provisional application No. 62/783,191, filed on Dec. 20, 2018.

(51) Int. Cl.

| | |
|---|---|
| ***A41D 11/00*** | (2006.01) |
| ***A47G 9/04*** | (2006.01) |
| ***A47G 9/02*** | (2006.01) |

(52) U.S. Cl.
CPC ..... *A41D 11/00* (2013.01); *A47G 9/0223* (2013.01); *A47G 9/04* (2013.01)

(58) Field of Classification Search
CPC ..... A41D 11/00; A41B 13/00; A41B 13/06; A41B 2400/00; A47G 9/0223; A47G 9/00;

(Continued)

(56) References Cited

U.S. PATENT DOCUMENTS 218,420 A * 8/1879 Baker ..... A41B 13/06 2/69.5
429,894 A * 6/1890 Doremus ..... A47G 9/0207 5/502

(Continued)

FOREIGN PATENT DOCUMENTS

WO 2017/079780 A1 5/2017

OTHER PUBLICATIONS

Ackerley et al., Positive Effects of a Weighted Blanket on Insomnia, J Sleep Med Disord 2(3):1022 (2015).

(Continued)

*Primary Examiner* — Heather Mangine
*Assistant Examiner* — Raquel M. Weis
(74) *Attorney, Agent, or Firm* — Workman Nydegger

(57) ABSTRACT

A wearable blanket with a distributed weight system for providing gentle and soothing weight on an infant's body without excessive pressure with optional swaddling wings that are removably attached to the wearable blanket. The wearable blanket has an array of subpanels containing weight or pressure-inducing material that can be adjusted to provide evenly distributed weight throughout the front panel of the wearable garment or create a weight gradient to provide more focused weighted support to particular areas of the wearable blanket depending on the physical or medical need of the wearer. The subpanels are compartmentalized and separated from one another to prevent undesirable movement or accumulation of weighed material and may include individual pouches or containers to hold the weight or pressure-inducing material that allows for customization and adjustment of any of a number of the subpanels that constitute the distributed weight system.

14 Claims, 10 Drawing Sheets

(58) Field of Classification Search
CPC ..... A47G 9/02; A47G 9/0207; A47G 9/08; A47G 9/083
See application file for complete search history.

(56) References Cited

U.S. PATENT DOCUMENTS 2,374,299 A * 4/1945 O'Hara ..... A41B 13/06 5/413 R
2,431,603 A * 11/1947 Zito ..... A41B 13/06 5/413 R
2,521,609 A * 9/1950 Segerman ..... A41B 13/06 2/69.5
2,562,061 A * 7/1951 Peterson ..... A41B 13/06 2/69.5
2,579,276 A * 12/1951 Schworm, Jr. ..... A41B 13/06 24/387
2,680,849 A * 6/1954 Munro ..... A41B 13/00 2/69.5
2,738,512 A * 3/1956 Winer ..... A41B 13/005 2/72
3,636,566 A * 1/1972 Sutherland ..... A41B 13/06 2/69.5
4,087,874 A * 5/1978 Callaway ..... A47G 9/083 5/413 R
4,268,917 A * 5/1981 Massey ..... A63B 21/065 2/102
4,295,230 A * 10/1981 Blodgett ..... A47G 9/083 2/69.5
4,384,369 A * 5/1983 Prince ..... A63B 21/065 2/81
4,407,497 A * 10/1983 Gracie ..... A63B 21/065 2/912
D296,378 S 6/1988 Coates
4,989,267 A * 2/1991 Watson ..... A63B 21/065 2/2.5
5,129,406 A * 7/1992 Magnusen ..... A41B 13/06 128/845
5,131,096 A * 7/1992 Olson ..... A41D 11/00 2/69.5
5,172,440 A * 12/1992 Ming ..... A47G 9/0261 5/419
5,199,121 A * 4/1993 Payne ..... A47G 9/023 5/413 R
5,457,829 A * 10/1995 Elliott ..... A47G 9/0207 5/490
5,570,474 A * 11/1996 Berry ..... A41D 1/215 2/48
5,659,898 A * 8/1997 Bell, Jr. ..... A63B 21/4025 2/69
5,706,535 A * 1/1998 Takashima ..... A47G 9/007 5/641
5,722,094 A * 3/1998 Ruefer ..... A41B 13/06 2/69.5
5,951,446 A * 9/1999 Monforte ..... A63B 21/065 2/456
5,996,152 A * 12/1999 Wilson ..... A47D 15/008 5/640
6,009,576 A * 1/2000 Gramme ..... A41B 13/06 5/413 R
6,209,135 B1 * 4/2001 Irvin ..... A63B 21/065 2/102
6,209,315 B1 4/2001 Weigl
6,286,146 B1 * 9/2001 Rocker ..... A63B 21/4001 2/102
6,314,580 B1 * 11/2001 Greenberg ..... A63B 21/0603 2/108
6,321,389 B1 * 11/2001 Sankey ..... A41B 13/06 2/69.5
6,662,390 B1 * 12/2003 Berger ..... A41B 13/06 5/655
6,817,033 B2 * 11/2004 Bailey ..... A41B 13/06 2/69.5
7,246,392 B2 * 7/2007 Schmid ..... A41B 13/06 5/655
7,870,623 B2 * 1/2011 Judd ..... A63B 21/4007 5/655.4
8,011,037 B1 * 9/2011 Earnest ..... A41B 13/06 2/69.5
8,215,773 B2 * 7/2012 Gibson-Horn ..... A63B 26/003 351/203
8,302,225 B1 * 11/2012 Earnest ..... A41B 13/06 5/413 R
8,863,329 B2 * 10/2014 Gangan ..... A41B 13/06 5/655
8,910,332 B2 * 12/2014 Buckson ..... A61F 5/3723 5/655
8,943,615 B2 * 2/2015 Howard ..... A41B 13/08 2/111
D728,198 S 5/2015 Barski
D728,199 S 5/2015 Barski
D731,144 S 6/2015 White
9,320,303 B2 * 4/2016 Howard ..... A41B 13/08
D772,532 S 11/2016 Karp
D778,534 S 2/2017 Bopanna et al.
9,572,376 B2 2/2017 Gangan et al.
9,693,589 B2 * 7/2017 Howard ..... A41B 13/005
D801,629 S 11/2017 Cook
D801,630 S 11/2017 Wollschlaeger et al.
D802,252 S 11/2017 Sack
D802,253 S 11/2017 Sack
D806,354 S 1/2018 Calodoukas
D851,361 S 6/2019 Barski
D851,362 S 6/2019 Barski
10,455,865 B2 * 10/2019 Barski ..... A47G 9/083
D866,122 S 11/2019 Karp et al.
D873,528 S 1/2020 Parker
D883,613 S 5/2020 Damir et al.
D901,132 S 11/2020 De Bourgknecht
D924,539 S 7/2021 Damir et al.
D924,540 S 7/2021 Lynch et al.
D925,864 S 7/2021 Scherer et al.
D946,238 S 3/2022 Park
D952,291 S 5/2022 Enuganti
D985,231 S 5/2023 Zhou
D993,573 S 8/2023 Zhu
2004/0019969 A1 * 2/2004 Gatten ..... A41B 13/06 2/69.5
2005/0120459 A1 * 6/2005 McConnell ..... G01K 13/20 374/E13.002
2006/0016005 A1 * 1/2006 Roda ..... A41B 13/06 5/482
2006/0064794 A1 * 3/2006 Howard ..... A41B 13/065 2/69
2006/0174410 A1 * 8/2006 Mastandrea, Jr. ... A01K 1/0353 5/482
2007/0028387 A1 * 2/2007 Mathis ..... A41B 13/00 5/655
2007/0056098 A1 * 3/2007 Schmid ..... A41B 13/06 2/69.5
2007/0239123 A1 * 10/2007 Pressler ..... A41B 13/00 604/361
2008/0005824 A1 * 1/2008 Seckinger ..... A41B 13/00 2/80
2009/0100568 A1 * 4/2009 Judd ..... A63B 21/4025 112/475.08
2011/0047698 A1 * 3/2011 Parker ..... A47G 9/0207 112/475.08
2011/0179546 A1 * 7/2011 Millette ..... A41B 13/06 2/75
2012/0284922 A1 * 11/2012 Gangan ..... A41B 13/06 5/494
2013/0017933 A1 * 1/2013 Foster ..... A41D 31/102 2/69
2013/0139290 A1 * 6/2013 Barski ..... A41B 13/06 2/69.5
2014/0259404 A1 * 9/2014 Walker ..... A47G 9/062 5/485
2014/0325735 A1 * 11/2014 Howard ..... A41B 13/08 2/80

(56) References Cited

U.S. PATENT DOCUMENTS

2015/0143603 A1* 5/2015 Howard ..... A41D 10/00
2/80
2015/0335853 A1* 11/2015 Orewiler ..... A61F 5/50
128/869
2015/0366734 A1* 12/2015 Kjell ..... A61M 21/02
601/84
2016/0128392 A1* 5/2016 Krawchuk ..... A47G 9/083
128/873
2016/0235128 A1* 8/2016 Howard ..... A41B 13/08
2016/0353809 A1 12/2016 Barski
2017/0127854 A1* 5/2017 Bui ..... A47L 13/08
2017/0224025 A1 8/2017 Villarreal
2017/0360117 A1* 12/2017 Wilds ..... A41B 13/005
2018/0035832 A1* 2/2018 Ureten ..... A61M 21/02
2018/0168240 A1* 6/2018 Parker ..... A41B 13/06
2018/0168372 A1* 6/2018 Pool ..... A47G 9/0207
2018/0228222 A1* 8/2018 Barski ..... A41B 13/06
2018/0317566 A1 11/2018 Barski
2018/0326175 A1* 11/2018 Figures ..... A61F 5/3723
2018/0332902 A1 11/2018 Damir et al.
2019/0021525 A1* 1/2019 Hamm ..... B32B 7/08
2019/0069609 A1* 3/2019 Blackburn ..... A41B 13/06
2019/0239573 A1 8/2019 Mercy
2019/0274454 A1* 9/2019 Bidhendi ..... A45C 13/10
2019/0313702 A1* 10/2019 Karp ..... A41B 13/065
2023/0077610 A1 3/2023 Williams
2023/0106389 A1 4/2023 Zeidman

OTHER PUBLICATIONS

Summe et al., Use of Weighted Blankets for Neonatal Abstinence Syndrome, Conference of the National Perinatal Association, Poster Session, p. 41 (2018).

International Preliminary Report on Patentability received for PCT Patent Application No. PCT/IB19/01362, dated Jul. 1, 2021, 9 pages.

International Search Report and Written Opinion received for PCT Patent Application No. PCT/IB19/01362, dated Oct. 14, 2020, 11 pages.

* cited by examiner

WEARABLE BLANKET WITH DISTRIBUTED WEIGHT SYSTEM

CROSS-REFERENCE TO RELATED APPLICATION

R1 This application claims priority to U.S. Provisional Application No. 62/783,191, filed Dec. 20, 2018, the disclosure of which is incorporated herein by reference in its entirety for all purposes.

FIELD OF THE INVENTION

The present invention relates generally to a weighted wearable blanket for infants and children. More particularly, this invention relates to a wearable blanket with a balanced distribution of weighted compartments for use to soothe infants and further, relates to a wearable blanket wherein the distribution of weighted compartments is adjustable to meet the particular needs of the wearer.

BACKGROUND

Colic is defined as frequent, prolonged, and intense crying or fussiness in a healthy infant. While the cause of colic is unknown, it may result from numerous contributing factors. According to the Mayo Clinic, possible contributing factors include a digestive system that is not yet fully developed, an imbalance of bacterial flora in the digestive tract, food allergies or intolerances, infrequent burping, overfeeding, underfeeding, and/or family stress or anxiety. One common method of soothing a colicky infant has been to hold the child in a "colic carry" or "football hold" wherein the infant is positioned so that the infant's stomach rests on the caregiver's forearm and his head is supported in the palm of the hand. The thought is that with the help of gravity, the infant finds comfort by having its stomach pressed against the caregiver's forearm.

Swaddling is another traditional method of soothing colicky infants or those that have trouble soothing themselves to sleep. For centuries, infants have been wrapped securely in blankets or strips of cloth in a practice known as swaddling. In addition to mimicking the close confines of the mother's womb, swaddling seeks to provide comfort, warmth, and relaxation to the infant that would normally be provided by the physical touch of a caregiver. It is also believed that secure binding of the limbs of the baby in a swaddle may prevent interruption of sleep caused by an infant's startle reflex and soothe the stomachs of those suffering from bouts of colic. The art of swaddling is typically taught by nurses, midwives, and healthcare professionals during childbirth classes or during post-natal stays in hospitals. However, incorrect or poor wrapping technique may result in the swaddling cloth or blanket becoming unwrapped or undone, which can pose a risk of suffocation in addition to defeating its intended purpose of providing a secure confined feeling to the infant. If the swaddle is too tight around the infant's body, it may constrict normal breathing and chest movement.

Critics of swaddling suggest that infants tend to sleep longer when they are provided kangaroo-care or given skin-to-skin contact with their mothers instead of swaddling. Because data about the benefits and safety of swaddling conflict, the American Academy of Pediatrics has not taken an official position regarding swaddling, but generally recommend that babies should not be swaddled past two months of age. Further, research has indicated that swaddling infant with hips and knees in an extended position may increase the risk of hip dysplastic and dislocation. In response to the limitations of manual swaddling and also in recognition of the potential risk of SIDS, sudden infant death syndrome, infant sleep sacks and wearable blankets that take the place of traditional swaddling blankets have become popular.

One example of a wearable infant blanket is SLEEPSACK™ wearable blanket available from Halo Innovations, Inc. of Plymouth, Minn., which is a sleeveless garment that fully encloses both legs in one compartment. As described in U.S. Pat. No. 7,246,392, the sleeveless garment can be worn with and without a swaddling accessory detachably secured to the wearable blanket. This garment is not a weighted blanket and does not provide a weighted component. Another infant wearable blanket is the ZEN SACK™ and ZEN SWADDLE™ wearable blanket products from Nested Bean, Inc. of Hudson, Mass. and described in U.S. Pat. Nos. 8,863,329 and 9,572,376. These garments have either a single oval weighted pad in the center of the chest area of the garment that contains pellets, beads, or padding that when worn, mimic the feel of a caregiver's hand on the infant's chest or two weighted protrusions on the sides of the torso to mimic arm and positions of a caregiver holding the infant. Both U.S. Pat. No. 8,863,329 and 9,572,376 teach a "wearable garment or swaddling blanket appliance [that] includes integrated protrusions in the form of pressure accessories for stimulating the slight pressure felt from a caregiver when holding or cradling an infant." As the intended purpose of these pressure accessories, these patents state that "the intent of the shape of the pressure accessories is to somewhat mimic human arms that have joints at the wrist and elbow which along with the fingers allow them to bend and anchor. The same effect is achieved by the weighted, elongated pressure accessories with respect to pressure applied along the length of an infant's torso." These integrated protrusions provide pressure in an oval area in the center of the chest or at points where the protrusions come into contact with the sides of the infant's torso. These patents do not teach a weighted blanket product having a distribution of weighted material over substantially all or the entirety of a front surface of a wearable garment or swaddling blanket.

Weighted blankets and vests are often utilized by occupational therapists and behavior specialists as part of a treatment plan for patients with autism spectrum disorder, ADHD, anxiety, those with sensory processing disorders or others who may benefit from sensory contact. It is also used for palliative care for cancer patients and individuals with chronic pain. Researchers are studying the effects of touch pressure on the human body with some studies showing a correlation between touch pressure and the release of serotonin, a chemical and neurotransmitter that is believed to help regulate biochemical mechanisms that affect mood, sleep, and relaxation. A study from the Journal of Sleep Medicine and Disorders from 2015 found that weighted blankets helped 21 out of 31 adult participants with insomnia fall asleep faster and achieve a more restful sleep. See Ackerley et al., *Positive Effects of a Weighted Blanket on Insomnia, J Sleep Med Disord* 2(3):1022 (2015). In a recent preliminary study of 16 infants, weighted blankets were found to be a safe intervention to use with infants with neonatal abstinence syndrome. When a one-pound weighted blanket was placed on infants for 30 minutes prior to feeding or sleeping for up to 4 times every 24 hours, infant heart rate decreased, and Finnegan scores decreased. Summer et al.,

*Use of Weighted Blankets for Neonatal Abstinence Syndrome*, Conference of the National Perinatal Association, Poster Session (2018).

Presently available infant blankets and swaddling implements do not provide gentle weight and pressure throughout the entirety of the front of the body to provide soothing comfort to an infant without providing undesirable weight or pressure. Further, there is no ability to adjust the level of weight or pressure in any area to suit a particular physical or medical need of the wearer. There is a continuing need for a new and improved wearable blanket that promotes security and comfort in infants and children.

SUMMARY

The present invention provides a wearable blanket with an adjustable distributed weight system for providing gentle and soothing weight on an infant's body without excessive pressure. Without wishing to be bound by theory, it is believed that the wearable blanket of the present invention helps babies fall asleep faster by providing deep pressure stimulation (DPS), which stimulates the feeling of being held, hugged, or cuddled and may increase the release of serotonin and melatonin while decreasing cortisol, a primary stress hormone. In general, the present invention provides a wearable blanket with a balanced and distributed weighted system that evenly distributes weight throughout a front panel of the garment to provide soothing weight to the front of the body from the clavicle down to the body that includes the chest and stomach area. In certain embodiments, the invention allows for adjustment of the weight and pressure of various parts of the wearable blanket to provide the desired level of weight and pressure support through an array of individual subpanels. Through its distributed weight system, the present invention fulfils the need for providing light pressure on specific pressure points including throughout substantially the entirety of the front of the body that help to minimize startle reflexes and restless body movements for a more soothing, deeper REM cycle sleep.

The distributed weight system of the present invention comprises a plurality of subpanels that encompass at least a significant portion or the entirety of an outer surface area of a front panel of the wearable blanket. The plurality of subpanels may form a distributed array of weight that provides gentle, even pressure on the front-side of the infant's body. The distributed array of weighted subpanels on a front panel of the wearable blanket forms a quilt-like outer face having a checkerboard or diamond configuration across the front panel.

In some embodiments, the front panel comprises a composite or laminate construction of multiple layers. The front panel may comprise a fabric material forming an outside surface of the front panel and one or more added layers of material forming an inside surface of the front panel, including, for example, a padding layer and a breathable layer suitable for direct contact with infant skin. In other embodiments, a front panel having a laminate construction of multiple layers further comprises individual pouches or containers of weighted material in between or adjacent to one or more layers of material.

In another embodiment of the present invention, the wearable blanket comprises one or more weighted braids or cording that is stitched, sewn, applied, bonded, or otherwise attached to the front panel. A plurality of braids or cording is arranged to form a distributed network of weighted portions on the front panel. The braids or cording comprises a medium or heavy density solid material such as fabric braids. Alternatively, the braids or cording can comprise a hollow or tubular member that is filled with a weight or pressure-inducing material such as beads, a polymeric gel or solid such as silicone, or fill material. The braids or cording may be attached to either an outside surface of the front panel or an inside surface of the front panel. In some embodiments, the front panel comprises a laminate construction of multiple layers, wherein the braids and cording may optionally be interspersed between a material forming an outside surface of the front panel and one or more added layers of material forming an inside surface of the front panel, including, for example, a padding layer and a breathable layer suitable for direct contact with infant skin. In certain embodiments, the wearable blanket further comprises one or more swaddling wings with weight or pressure-inducing material that can each be wrapped across an infant's torso and/or tucked under the sides of the garment and secured to either the sides of the garment or the rear of the wearable blanket.

DETAILED DESCRIPTION

Figure 1:
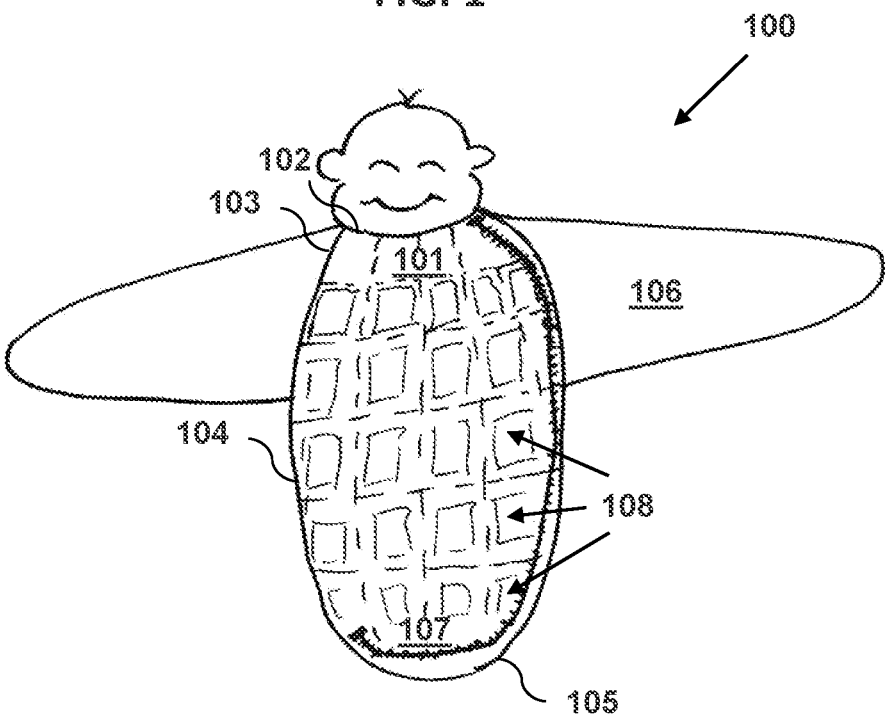
FIG. 1 is a frontal view of an infant wearing a wearable blanket having a system of weighted subpanels across the front of the blanket and a leg pouch with a rounded silhouette and with optional swaddling wings.
Figure 2:
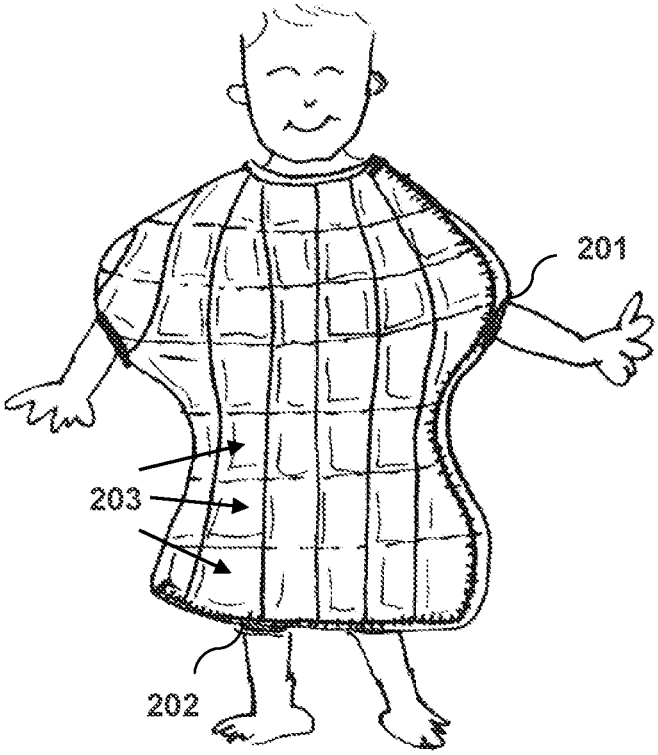
FIG. 2 is a frontal view of a child wearing a wearable blanket having a system of weighted subpanels across the front of the blanket and having arm openings and feet openings.

Referring now to the figures, an exemplary embodiment of a distributed weight wearable blanket 100 is shown in FIG. 1. A front panel 101 having an outside edge corresponding to a neck opening 102, shoulders 103, sides 104, and a bottom edge 105 are sewn along the outside edge of a rear panel with the exception of certain parts of the outside edge to form a garment that covers the infant from his neck to his feet and which has a neck opening. In the embodiment shown in FIG. 1, the garment is sewn or constructed such that there are no arm openings. A wearable blanket that does not have arm openings is particularly desirable when the wearer is between 0-3 months old. The garment may have one or two optional swaddling arms or wing 106 to secure the arms underneath the wings, or if there are no arm openings, to secure the arms from movement within the garment. Other embodiments include arm openings that may be opened to allow free arm movement when the infant is old enough to roll over. As shown in FIG. 2, arm openings 201 along the sides of the garment and optional foot openings 202 at the bottom edge of the garment are provided in certain embodiments where the intended wearer is a toddler between 12 to 36 months or a child between 3 to 6 years in age. Instead of being sewn together, the front and rear panels may be knitted, woven, bonded, adhered or otherwise attached to one another along the outside edges to form the garment.

Figure 3:
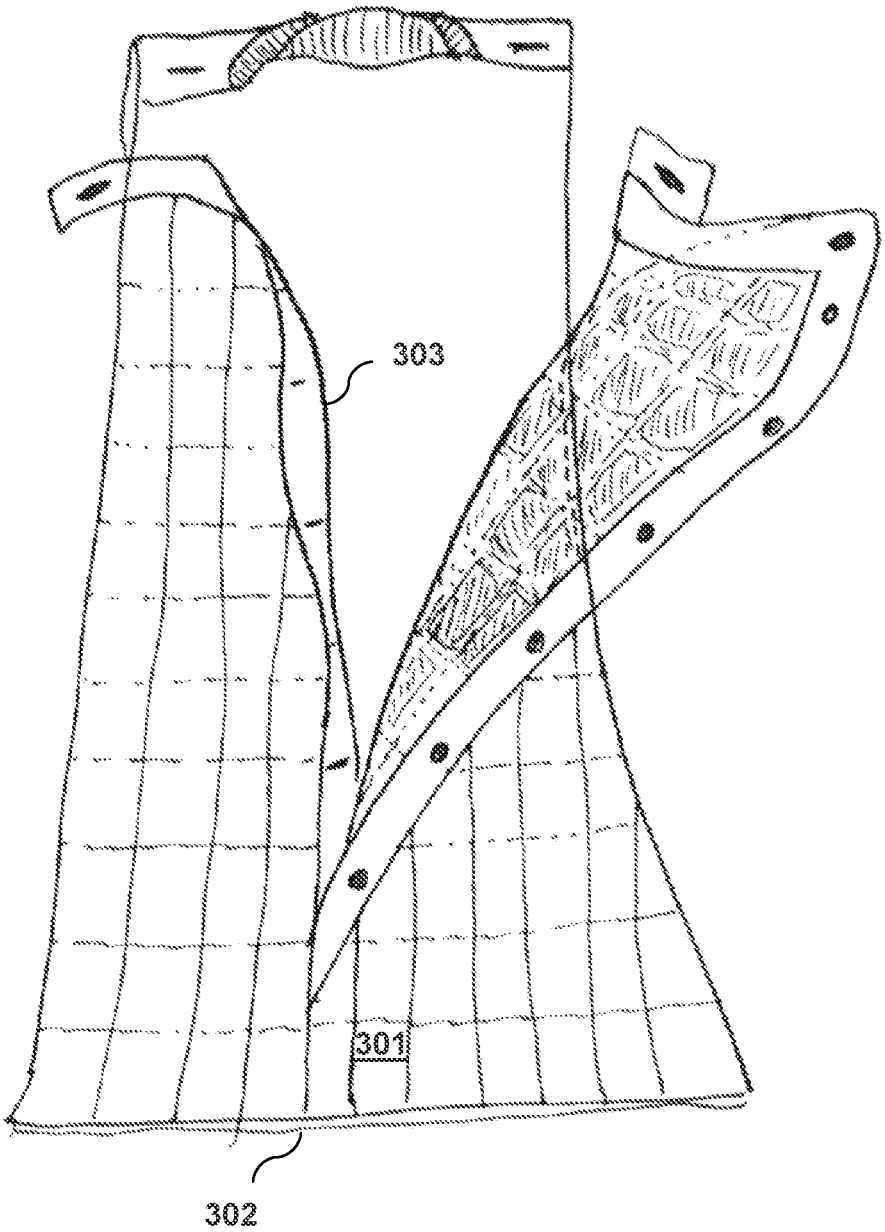
FIG. 3 is a frontal view of a wearable garment according to an embodiment of the invention showing a leg pouch with a dress silhouette, a sleeveless design, and a distributed weight system comprising an array of subpanels that form a quilted grid on the front of the garment.

In certain embodiments, the bottom edges of the front panel and rear panel are sewn, bonded or otherwise attached to one another to form a leg pouch capable of holding both of the wearer's legs. In some embodiments, the leg pouch 107 comprises a rounded edge 105 such that the garment has a rounded or oval silhouette, as shown in FIG. 1. In the exemplary embodiment as shown in FIG. 3, the leg pouch 301 forms a straight edge 302 on its bottom edge such that the garment appears to have the general silhouette of a dress.

In certain embodiments, the garment has an opening 303 down the center of the front of the garment, such that the garment may be opened from the neck opening down towards the leg pouch portion that will occupy both of the infant's feet, with the opening having one or more zippers disposed thereon to selectively open and close the opening. Alternatively, the opening has buttons, a hook-and-loop fastener, snaps, or other fastener disposed in the opening. In another embodiment of the invention, the opening for the wearable blanket is positioned in other areas of the blanket. In an exemplary embodiment, the wearable blanket has a side opening down the length of the side of the garment with a zipper or other fastening mechanism therein. In other embodiments, the garment has an L-shaped opening down one side of the garment and across the bottom edge of the garment to allow for the infant or child to be easily placed inside and removed from the wearable blanket. The zipper may optionally be covered by a zipper cover. The zipper may also be a double or two-way zipper that can open and close in both directions.

As shown in FIG. 2, the front panel has a plurality of subpanels 203 that encompass at least a significant portion or the entirety of an outer surface area of the front panel. The plurality of subpanels may form a distributed array of weighted elements that provides gentle, even pressure on the front side of an infant's body without excessive pressure that may result from a single weighted area on the chest of the infant or on the sides of the blanket. The distributed array of weighted subpanels forms a distributed system of weights that provides the front panel with a pleasing aesthetic of a quilt-like outer face. As used herein, "weighted subpanel" refers to a wearable blanket or garment comprising a first material and a second filler material, wherein the density of the filler material is substantially higher than the density of the first material, wherein substantially higher means a density that is more than about 50% of the density of the first material. In certain embodiments, the plurality of subpanels forms a grid-like, checkerboard, or diamond configuration across the front panel. In certain embodiments, the "distributed array" constitutes weights, weighed elements, weight or pressure-inducing material, or weighted subpanels that are distributed within an array.

The array of subpanels can be coextensive with, for example, from 50% to 100%, e.g., from 50% to 90%, from 55% to 85%, from 60% to 90%, from 65% to 95%, or from 70% to 100% of the garment front, e.g., the front panel. In terms of lower limits, the array can be coextensive with at least 50%, e.g., at least 55%, at least 60%, at least 65%, at least 70%, at least 75%, at least 80%, at least 85%, at least 90%, or at least 95% of the front panel. In terms of lower limits, the array can be coextensive with less than 100%, e.g., less than 95%, less than 90%, less than 85%, less than 80%, less than 75%, less than 70%, less than 65%, less than 60%, or less than 55% of the front panel. As used herein, the term "coextensive" refers to a relationship between two or more layers such that the surface areas of adjacent or parallel faces of the layers are aligned with one another with relatively little or no overhang (of at least one of the areas or layers). For example, the array of weighted subpanels can be coextensive with the garment front, e.g., the front panel of the wearable blanket. In some cases, the extents of the areas or faces are within 90% of one another. For example, two or more layers are coextensive if the surface areas of adjacent or parallel faces of the layers are within 90%, within 92%, within 94%, within 96%, or within 98% of one another. The term "coextensive" can also refer to a relationship between two or more layers such that the lengths of the layers are within 90% of one another. For example, two or more layers are coextensive if the lengths of the layers are within 90%, within 92%, within 94%, within 96%, or within 98% of one another. The term "coextensive" can also refer to a relationship between two or more layers such that the widths of the layers are within 90% of one another. For example, two or more layers are coextensive if the widths of the layers are within 90%, within 92%, within 94%, within 96%, or within 98% of one another.

Each individual subpanel contains weight or pressure-inducing material comprising glass beads, plastic or polypropylene beads, a polymeric or elastomeric gel or solid such as a silicone gel pack, or poly fill material. batting material, dense fiber, felted material, fiber fill, torn fabric, fabric pellets, or other material to provide weight-giving properties to the subpanel. In another embodiment, as exemplified in FIG. 1, the wearable blanket has a sleeveless design and the distributed weight system comprises a grid of subpanels 108 that hold weight or pressure-inducing material. Optionally, the sleeveless design comprises shoulder portions having a front portion and a rear portion that are either sewn to each other or detachably fastened with buttons, snaps, a hook-and-loop fastener or other suitable fastener.

In order to prevent shifting of the contents of the subpanels and to preserve the integrity of the distributed network of weights, the contents of each subpanel are compartmentalized and otherwise separated from the contents of other subpanels by a sewn, stitched or bonded border around each subpanel. In certain embodiments, the subpanels are either hand or machine stitched to form a stitched border around each subpanel. In one embodiment, the subpanels comprise double gridded stitching that ensures that the weight or pressure-inducing material contained in the subpanels remain safely in place and uniformly distributed. The stitching may extend through all or some of the layers of the weighted garment. In other embodiments, the contents of each subpanel are held in an individual pouch or container that is sewn, stitched, bonded, sealed or otherwise held into place on front panel. The individual pouch or container containing the weight or pressure-inducing material may be held into place beneath the sheet material that forms the front panel of the blanket. The subpanel may further comprise batting or fill material to provide cushioning and comfort or to lessen the feel of the beads or other of weight or pressure-inducing material contained therein. The wearable blanket has an array of subpanels containing weight or pressure-inducing material that can be adjusted to provide evenly distributed weight throughout the front panel of the wearable garment or create a weight gradient to provide more focused weighted support to particular areas of the wearable blanket depending on the physical or medical need of the wearer. Whether, stitched, sewn, or bonded, the subpanels are compartmentalized and separated from one another to prevent undesirable movement or accumulation of weighed material and may, optionally include individual pouches or containers to hold the weight or pressure-inducing material that allows for customization and adjustment of any of a number of the subpanels that constitute the distributed weight system The width of each subpanel can independently be, for example, between 0.5 inches and 1.5 inch, e.g., between 0.5 inches and 1.1 inches, between 0.6 inches and 1.2 inches, between 0.7 inches and 1.3 inches, between 0.8 inches and 1.4 inches, or between 0.9 inches and 1.5 inches. In terms of upper limits, the subpanel width can be less than 1.5 inches, e.g., less than 1.4 inches, less than 1.3 inches, less than 1.2 inches, less than 1.1 inches, less than 1 inch, less than 0.9 inches, less than 0.8 inches, less than 0.7 inches, or less than 0.6 inches. In terms of lower limits, the subpanel width can be greater than 0.5 inches, e.g., greater than 0.6 inches, greater than 0.7 inches, greater than 0.8 inches, greater than 0.9 inches, greater than 1 inch, greater than 1.1 inches, greater than 1.2 inches, greater than 1.3 inches, or greater than 1.4 inches. Larger subpanel widths, e.g., greater than 1.5 inches, and smaller subpanel widths, e.g., less than 0.5 inches, are also contemplated.

In some embodiments, the front panel comprises a laminate construction of multiple layers. In certain embodiments, the layered construction of the wearable garment comprises an outer exterior of 100% cotton, a first inner layer comprising a lightweight cotton muslin, a second inner layer of weight-inducing material such as virgin poly pellet beads, a third inner layer of lightweight cotton muslin, and a four inner layer made of 100% cotton that touches the infant's skin. The front panel may comprise a quilted material forming an outside surface of the front panel and one or more added layers of material forming an inside surface of the front panel, including, for example, a padding layer and a breathable layer suitable for direct contact with infant skin. In other embodiments, a front panel having a laminate construction of multiple layers further comprises individual pouches or containers of weighted material in between one or more layers of material.

The wearable garment further comprises a back panel, which is devoid of a layer of weight-inducing material in the form of beads, or the like. In certain embodiments, the laminate construction of the back panel is identical to that of the front panel other than the lack of a weight-inducing material in the form of beads, pellets, or the like as described herein. In certain embodiments, the back panel also comprises a quilted surface or can comprise a non-quilted and relatively smooth fabric surface. In certain embodiments where the wearable garment includes sleeves, the front surfaces of the arms constitute a part of the front panel and are constructed identically or substantially similarly to that of the front panel and the back surfaces of the arms constitute a part of the back panel and are constructed similarly to that of the back panel. In other embodiments, both the front and back surfaces are constructed identically or substantially similarly to that of the front panel.

In certain embodiments of the invention, the subpanels contain an equal amount of weighted or pressure-inducing material and the wearable blanket provides evenly distributed weight throughout the front panel. The subpanels can, for example, have weights that are substantially equal, e.g., that differ by less than 20%, less than 18%, less than 16%, less than 14%, less than 12%, less than 10%, less than 8%, less than 6%, less than 4%, or less than 2%, from one another. In other embodiments, some of the subpanels, may be filled with more or less material or denser materials such that the subpanels as a whole provide more concentrated weight or pressure inducing effects in certain regions. For example, some of the subpanels in the middle of the blanket that would come into contact with the infant's abdominal area, may be more heavily weighed than other subpanels if the intended use is to relieve gaseous or abdominal discomfort. In certain embodiments, the distributed weight system may be composed of subpanels that have a weight gradient such that certain subpanels provide more weight or pressure, such as in the abdomen area, and less in other areas, such as the middle of the chest to allow for unencumbered breathing.

In an exemplary embodiment, the subpanels contain removable or replaceable pouches, bags, or containers of weight or pressure-inducing material, and the weight of the subpanel contents can be adjusted or changed according to a desired level of comfort or need. For example, as an infant or child grows or needs change, some or all of the subpanels can be filled with heavier weights or a pressure inducing material. The system of distributed weights is changeable and adjustable by changing the weight contained in one or more subpanels in accordance with an individual physical and medical needs. For example, the contents of the subpanels that correspond to the abdomen area of the front panel or the shoulder areas of the front panel may be increased in weight and the contents of the subpanels that correspond to the chest area of the front panel can be decreased in weight to create a weight gradient throughout the wearable garment to provide more focused weight or pressure in the abdomen region and/or shoulder regions while providing gentler and soothing weight support on the chest and lung region.

In certain embodiments, the weights of the weighted subpanels are substantially equal where it is desired to provide an even distribution and/or a uniform weight or pressure-inducing effect throughout the front of the garment. In other embodiments, for example, for providing greater therapeutic effect on a specific part of the anatomy such as the abdominal area, the weighted subpanels located in an abdominal region of the garment are greater than the weights of the weighted subpanels located outside of the abdominal region. In embodiments wherein some of the weighted subpanels contain a greater quantity or weight of a weight-inducing material, it is not desired to provide a bulky, protrusion-like profile. However, regardless of whether the subpanels contain the same amount of weighted material to form a uniform, equal, or relatively even distribution of weight throughout the front of the garment or different amounts of the weighted material to form a weight gradient or weight differential across the garment front, the distributed weight system provides an array that is coextensive with the garment front, e.g., the front panel of the wearable blanket and is consistent with the coextensive feature as described above. Thus, in certain embodiments of the invention, the garment possesses weighted subpanels throughout the entirety or at least 90% of the front surface of the wearable garment and all of the individual weighted subpanels contain the same mass of weight providing material. In other embodiments, the garment possesses weighted subpanels throughout the entirety or at least 90% of the front surface of the wearable garment; however, some of the weighted subpanels have a greater mass of weight providing material than other subpanels.

The weight of material to be included in a single subpanel can be adjusted in accordance with medical guidelines but typically ranges from about a half an ounce to about 4 ounces with the total weight of the wearable blanket typically not exceeding about 10% of the body weight of the wearer. The weighted subpanels can each independently have a weight that is, for example, between 0.5 ounces and 4 ounces, e.g., between 0.5 ounces and 2.6 ounces, between 0.85 ounces and 2.95 ounces, between 1.2 ounces and 3.3 ounces, between 1.55 ounces and 3.65 ounces, or between 1.9 ounces and 4 ounces. In terms of upper limits, each subpanel can have a weight less than 4 ounces, e.g., less than 3.65 ounces, less than 3.3 ounces, less than 2.95 ounces, less than 2.6 ounces, less than 2.25 ounces, less than 1.9 ounces, less than 1.55 ounces, less than 1.2 ounces, or less than 0.85 ounces. In terms of lower limits, each subpanel can have a weight greater than 0.5 ounces, e.g., greater than 0.85 ounces, greater than 1.2 ounces, greater than 1.55 ounces, greater than 1.9 ounces, greater than 2.25 ounces, greater than 2.6 ounces, greater than 2.95 ounces, greater than 3.3 ounces, or greater than 3.65 ounces. Heavier subpanel weights, e.g., greater than 4 ounces, and lighter subpanel weights, e.g., less than 0.5 ounces, are also contemplated.

The total weight of the wearable blanket can be, for example, between 0.5 pounds and 5 pounds, e.g., between 0.5 pounds and 2 pounds, between 0.6 pounds and 2.5 pounds, between 0.8 pounds and 3.2 pounds, between 1 pound and 4 pounds, or between 1.3 pounds and 5 pounds. In terms of upper limits, the blanket weight can be less than 5 pounds, e.g., less than 4 pounds, less than 3.2 pounds, less than 2.5 pounds, less than 2 pounds, less than 1.6 pounds, less than 1.3 pounds, less than 1 pound, less than 0.8 pounds, or less than 0.6 pounds. In terms of lower limits, the blanket weight can be greater than 0.5 pounds, e.g., greater than 0.6 pounds, greater than 0.8 pounds, greater than 1 pound, greater than 1.3 pounds, greater than 1.6 pounds, greater than 2 pounds, greater than 2.5 pounds, greater than 3.2 pounds, or greater than 4 pounds. Heavier blanket weights, e.g., greater than 5 pounds, and lighter blanket weights, e.g., less than 0.5 pounds, are also contemplated.

Figure 4:
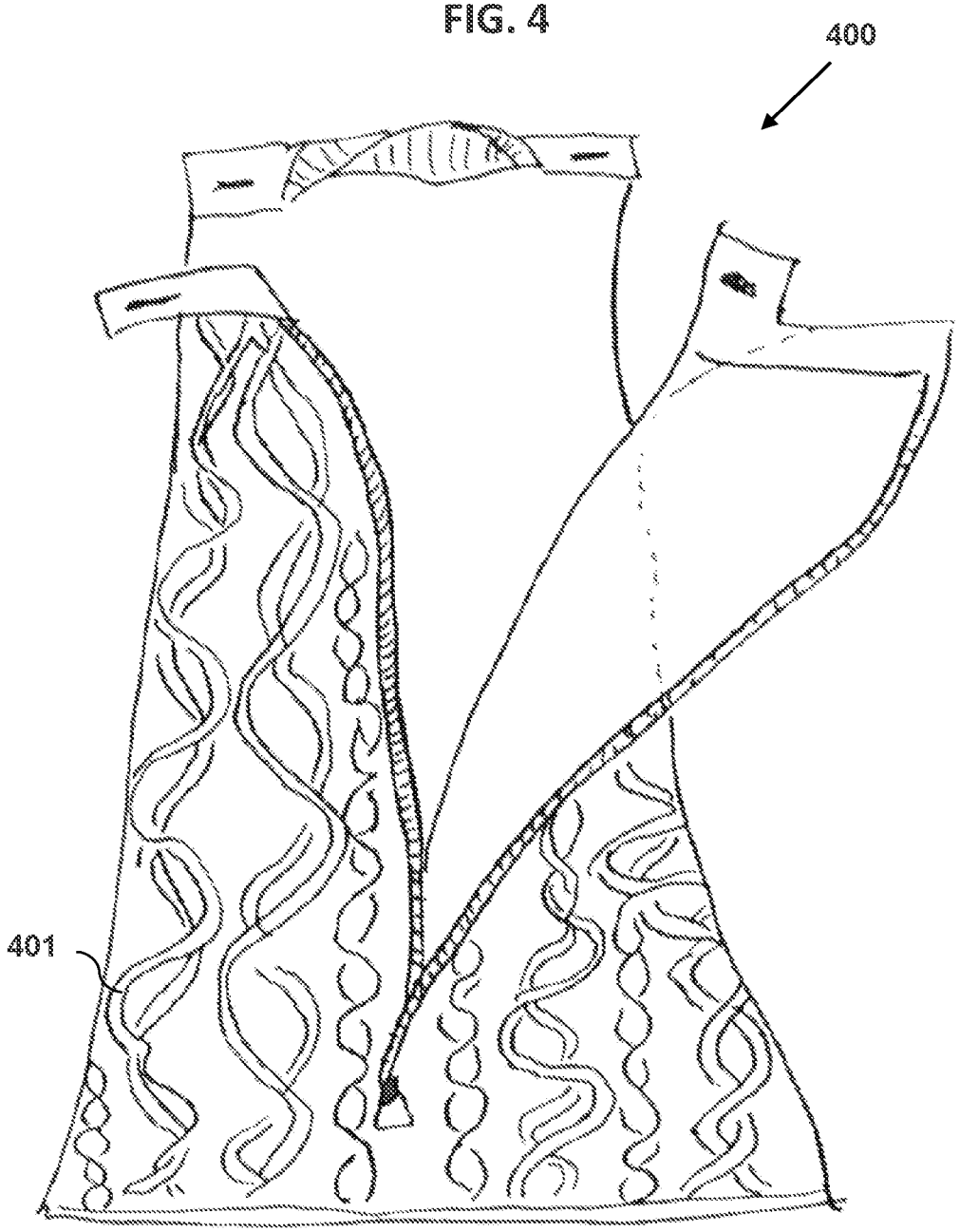
FIG. 4 is a frontal view of a wearable garment according to an embodiment of the invention showing a sleeveless design and a distributed weight system comprising a plurality of heavy fabric braids disposed on the outside face of the front of the garment.

In another embodiment of the present invention, as exemplified by FIG. 4, instead of subpanels containing weighted or pressure-inducing material, the wearable blanket 400 comprises one or more weighted braids 401 or cording stitched, sewn, applied, bonded, or otherwise attached to the front panel. A plurality of braids or cording is arranged to form a distributed network of weighted portions on the front panel. The braids or cording comprises a medium or heavy density solid material such as fabric braids. Alternatively, the braids or cording can comprise a hollow or tubular member that is filled with a weight or pressure-inducing material such as beads, a polymeric or elastomeric gel or solid comprising silicone, or poly fill material. The braids or cording may be attached to either an outside surface of the front panel or an inside surface of the front panel. In some embodiments, the front panel comprises a laminate construction of multiple layers, wherein the braids and cording may optionally be interspersed between a material forming an outside surface of the front panel and one or more added layers of material forming an inside surface of the front panel, including, for example, a padding layer and a breathable layer suitable for direct contact with the skin of the wearer.

The wearable blanket can be made from one or more sheet materials such as fabric or flexible non-fabric materials and the fabric can be natural, synthetic, or blends of fabric comprising cotton, polyester, a cotton-polyester blend, satin, velvet, velour, fur-like fabric, minky fabric, plush fabric, terry cloth, rayon, microfleece, fleece, Sherpa fleece, jersey cotton, quilted fabric, ribbed fabric to provide one or more desired characteristics including warmth, breathability, washability, weight, aesthetic appeal, sensory appeal, fire resistance, water resistance, and/or durability. The wearable blanket can be constructed of a single type of material or made from two or more materials for different parts of the wearable blanket or have a composite or laminate construction of two or more layers of fabric or other materials for one or more parts of the wearable blanket. In certain embodiments, the wearable blanket has a diamond quilted front surface and is machine washable.

Figure 5:
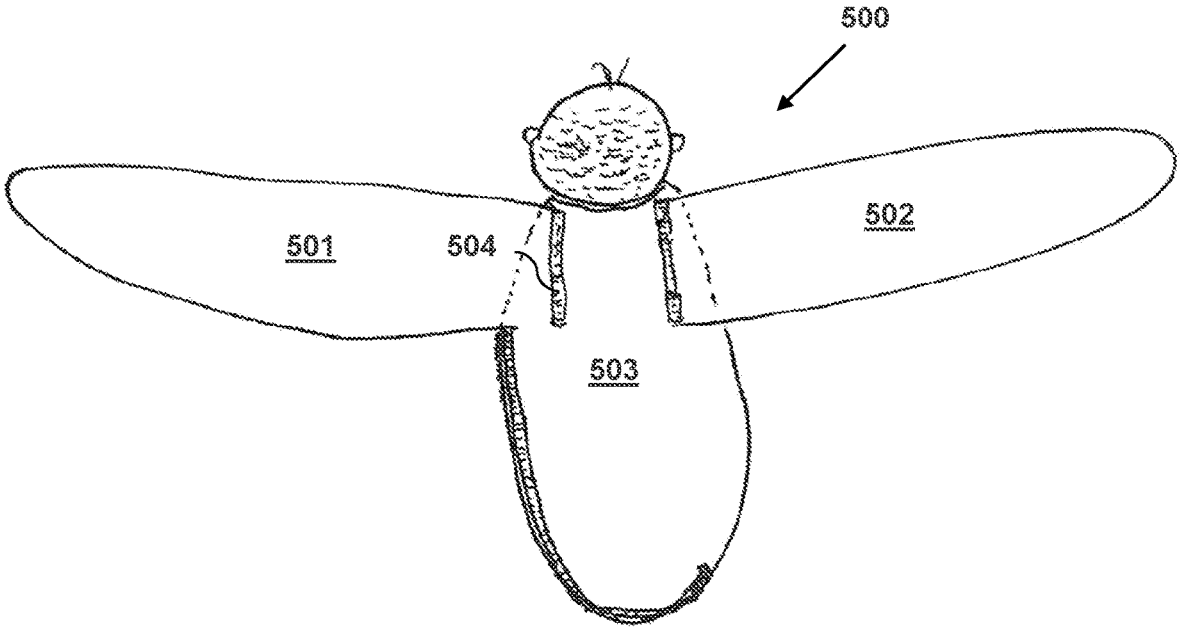
FIG. 5 is a back view of a wearable blanket that features removable swaddling wings that are attached to the back of the wearable blanket.

In certain embodiments, the wearable blanket further comprises one or more swaddling wings made of one or more layers of fabric. In one embodiment, as shown in FIG. 5, the wearable blanket 500 comprises a first wing 501 and a second wing 502. The first wing extends from a first side of a back panel 503 and the second wing extends from a second side of the back panel. The first wing and second wing can each be wrapped across an infant's torso and/or tucked under the sides of the garment and secured to either the sides of the garment or the rear panel. In some embodiments, each swaddling wing is tapered such that it tapers from the back panel to the wing tip. In other embodiments, the wearable blanket comprises a single swaddling wing that is wrapped around the infant. In yet another embodiment, the one or more swaddling wings are removably attached to the wearable blanket by hook-and-loop attachment 504, buttons, zipper or other fastening mechanism to attach, detach, and reattach the one or more wings to the back panel or one or more sides of the blanket.

Figure 6:
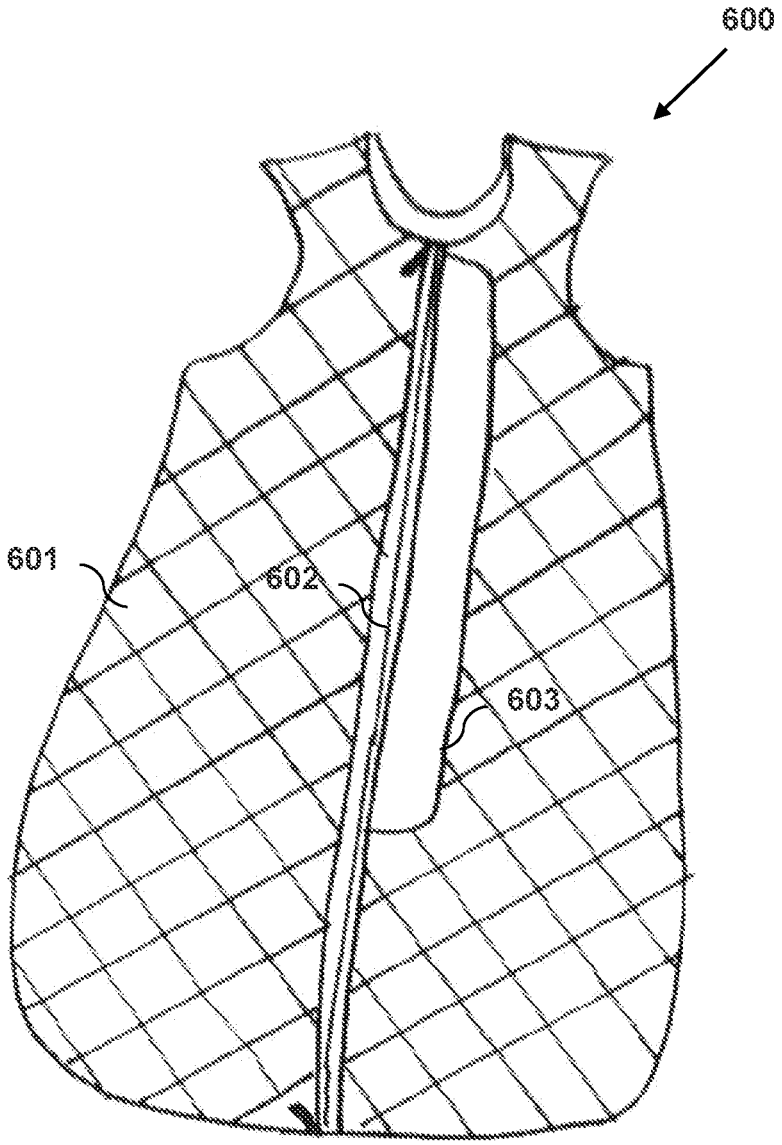
FIG. 6 is a frontal view of a wearable garment according to an embodiment of the invention showing a sleeveless design and a distributed weight system comprising weighted subpanels that are distributed across the front surface of the garment to form an array of weighted subpanels shown as a quilted diamond-shaped grid on the front of the garment. The array of weighted subpanels is coextensive with the garment front. The garment has a zipper for zipping or unzipping the garment from either top or bottom of the front of the garment and a flap for covering the zipper.

As shown in FIG. 6, which is a frontal view of a wearable garment 600 according to an embodiment of the invention showing a sleeveless design, the weighted subpanels are distributed across the front surface 601 of the garment to form an array shown as a quilted diamond-shaped grid on the front of the garment. FIG. 6 shows the array of weighted subpanels as coextensive with the garment front. The garment has a two-way zipper 602 for zipping or unzipping the garment from either top or bottom of the front of the garment and a zipper flap 603 for covering the zipper. The garment of FIG. 6 features a zipper flap that extends at least a portion of the length of the two-way zipper. The array of weighted subpanels in the sleeveless wearable garment as shown in FIG. 6, provides about 1.6 pounds of weight-providing material.

Figure 7:
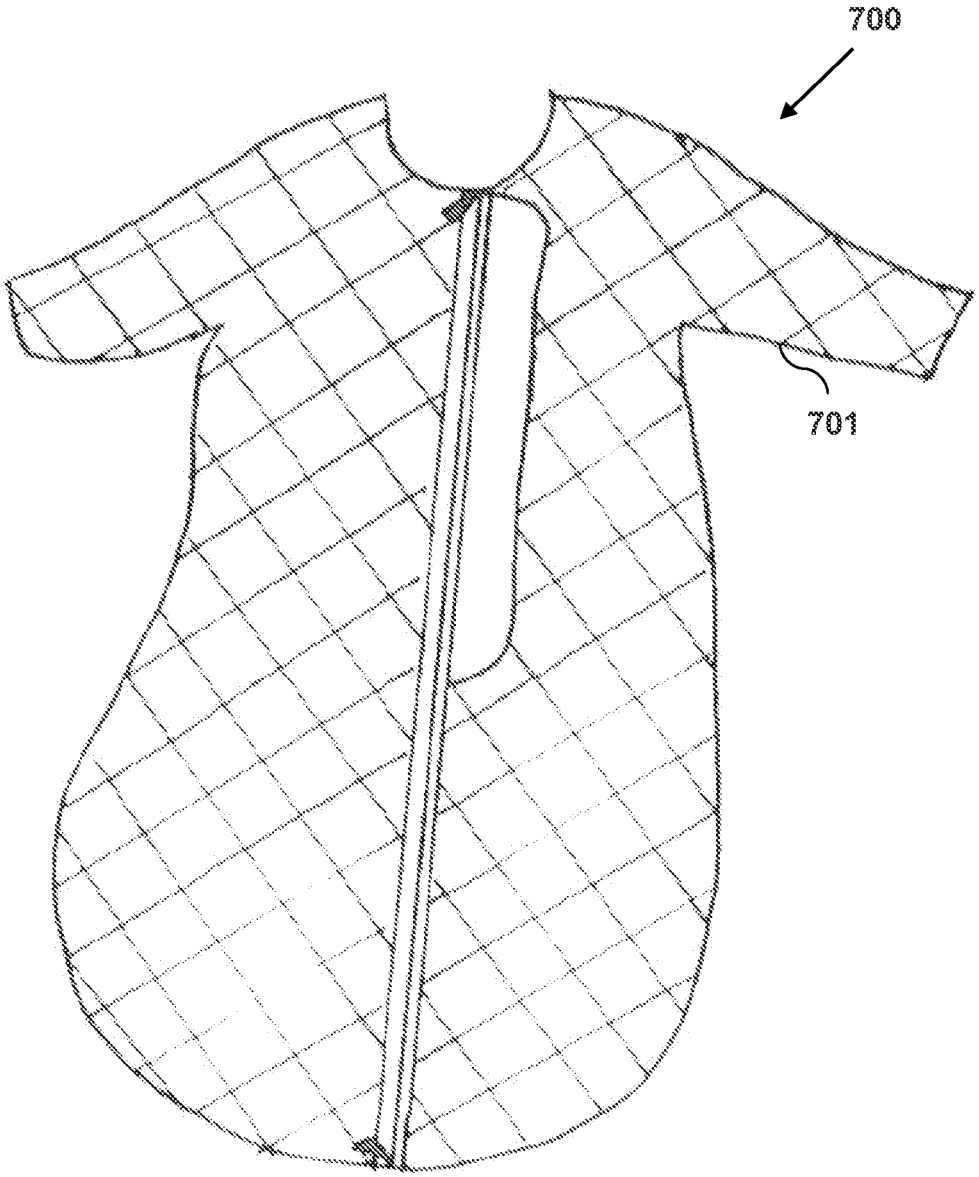
FIG. 7 is a frontal view of a wearable garment having two sleeves according to an embodiment of the invention and a distributed weight system comprising weighted subpanels that are distributed across a front surface of the garment, and the weighted subpanels are distributed across a front surface of each of the two sleeves.

FIG. 7 shows a wearable garment 700 according to an embodiment of the invention that features a long-sleeved design. The garment includes two sleeves 701 and, as seen in FIG. 7, weighted subpanels are distributed across the front surface of the garment, including front surfaces of the sleeves to form an array shown as a quilted diamond-shaped grid on the front of the garment.

Figure 8:
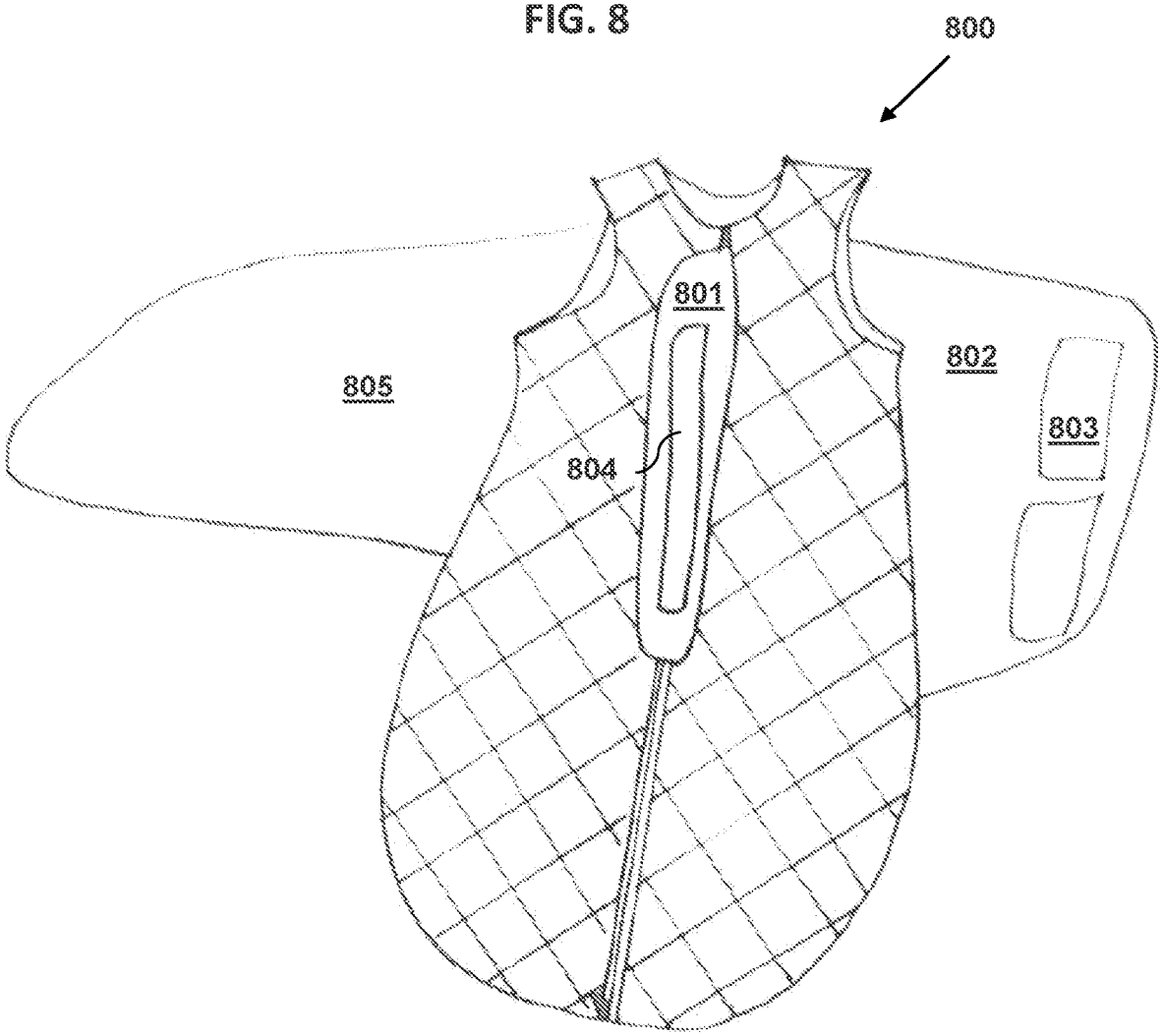
FIG. 8 is a front view of a sleeveless wearable garment having a distributed weight system according to an embodiment of the invention. The garment has a zipper with a flap for covering at least a portion of the zipper and two replaceably detachable wings, a first wing having loops of a hook-and-loop mechanism for engaging with hooks on a surface of the zipper flap, and a second wing for swaddling across the front surface of the garment and engaging with loops on a surface of the first wing or on a side or back surface of the garment.

Turning now to FIG. 8, a sleeveless embodiment of the wearable garment 800 is shown with a distributed weight system according to an embodiment of the invention. The garment has a two-way zipper mechanism with a flap 801 for covering at least a portion of the zipper mechanism and two replaceably detachable wings. As described above, these optional replaceably detachable wings may be used to create a swaddling effect in infants and can be used singly or together. The array of weighted subpanels in the sleeveless wearable garment as shown in FIG. 8, provides about 0.8 pounds of weight-providing material. The first wing 802 has one or more portions having loops of a hook-and-loop mechanism 803 for engaging with hooks on a hook-and-loop fastening surface of the zipper flap. As shown in FIG. 8, the first wing has two sections of loops of a hook-and-loop fastener on the front surface of the first wing and the zipper flap has hooks 804 of a hook-and-loop fastener on one more both sides of the flap and the first wing may attach to at least some of the hooks of the zipper flap. The second wing 805 provides a swaddling effect when pulled across the front surface of the garment and tucked around the front torso of the wearer of the garment by engaging a portion of the second wing with loops either on a back surface of the first wing or on a side or back surface of the garment.

Figure 9:
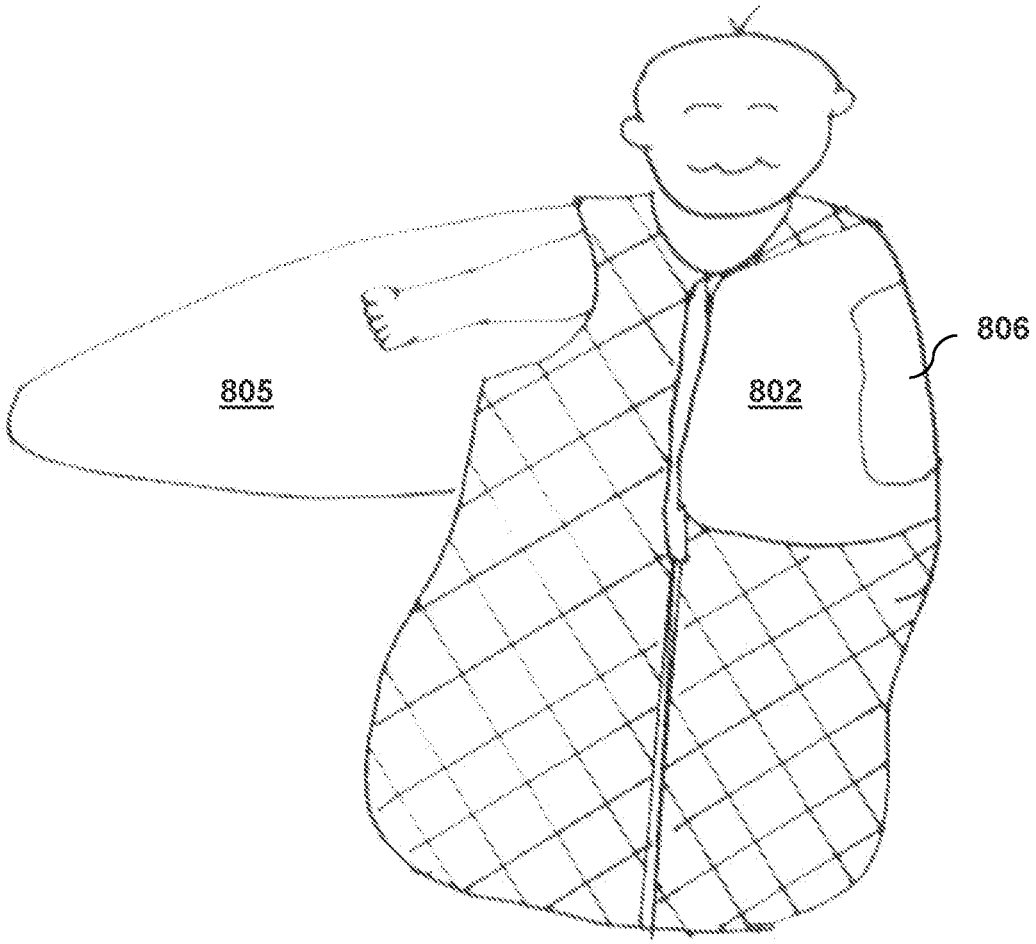
FIG. 9 is a frontal view of an infant wearing the wearable blanket of FIG. 8 having a system of weighted subpanels across the front of the blanket, a zipper, a zipper flap, and two replaceably detachable wings. A first wing is shown wrapped across a front surface of the blanket and attached to a surface of the zipper flap. The wrapped first wing shows a portion of its surface having loops of a hook-and-loop mechanism for engaging with a second wing that may be wrapped across the front torso of the infant.

FIG. 9 illustrates the garment of FIG. 8 as worn by an infant. It provides a frontal view of an infant wearing the wearable blanket of FIG. 8 having a zipper, a zipper flap, and two replaceably detachable wings. A first wing 802 is shown wrapped across a front surface of the blanket and attached to a surface of the zipper flap. Once the first wing is secured to the zipper flap, it serves the purpose of helping to secure the second wing. As shown in FIG. 9, the wrapped first wing shows a portion of its back surface having loops 806 of a hook-and-loop mechanism for engaging with a second wing that may be wrapped across the front torso of the infant. Optionally, the first wing may be detached and only the second wing 805 utilized, in which case, the ends of the second wing may be secured to a back surface of the garment or a surface of the second wing itself; for example, a first end of the second wing may be attached to a back surface of the garment and the wring wrapped around the torso of the wearer of the garment and a second end of the second wing secured to a portion of the back surface of the garment or on a surface of the second wing itself.

Figure 10:
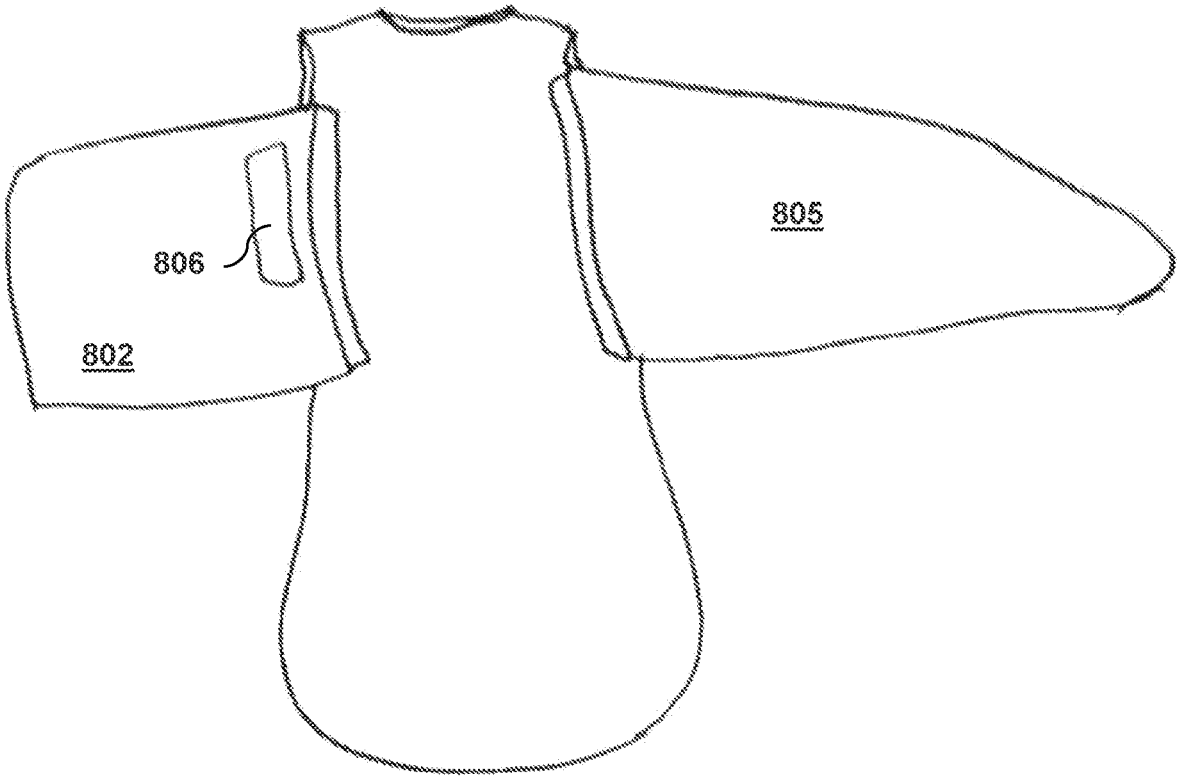
FIG. 10 shows the back view of the wearable blanket of FIG. 8, showing two replaceably detachable wings attached to a back surface of the blanket. As shown in this back view of the blanket, a portion of the surface of a first wing contains loops of a hook-and-loop mechanism.
Figure 11:
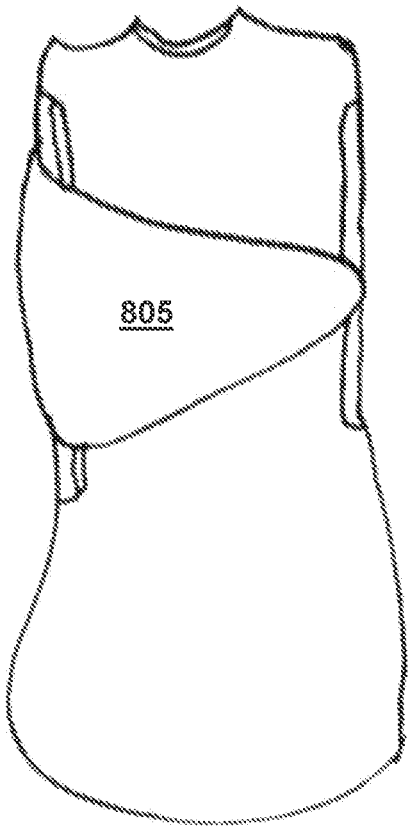
FIG. 11 shows the back view of the wearable blanket of FIG. 10, showing the second wing wrapped across the front surface of the garment and attached to loops of a hook-and-loop mechanism on a portion of the first wing.

The blanket of FIG. 8 is further illustrated by FIG. 10, which shows a back view of the wearable blanket of FIG. 8, showing two replaceably detachable wings attached to a back surface of the blanket. As shown in this back view of the blanket, a portion of the back surface of the first wing 802 contains loops 806 of a hook-and-loop mechanism that, when the first wing is wrapped and attached to the zipper flap, provides an attachment point for securing to a front surface (not shown) of the second wing 805 that is swaddled around the torso of the wearer of the garment. This is further illustrated in FIG. 11, which shows a back view of the wearable blanket of FIG. 8 where the first wing is wrapped and attached to the zipper cover and the second wing 805 has been swaddled around the torso of the infant and attached to a portion of the back surface of the first wing having loops of a hook-and-loop fastener.

The following embodiments are contemplated. All combinations of features and embodiment are contemplated.

Embodiment 1: A wearable weighted blanket having the form of a garment including a neck opening, the blanket comprising: a front panel comprising an outer surface; and an array of a plurality of weighted subpanels, wherein the array is coextensive with and connected to at least a portion of the front panel outer surface.

Embodiment 2: An embodiment of embodiment 1, wherein each weighted subpanel comprises a pouch independently holding a weighted material.

Embodiment 3: An embodiment of embodiment 2, wherein the pouch of each weighted subpanel is removable and replaceable.

Embodiment 4: An embodiment of embodiment 2 or 3, wherein the weighted material comprises glass beads, plastic beads, a polymeric gel, silicone, or a combination thereof.

Embodiment 5: An embodiment of any of the embodiments of embodiment 1-4, wherein each weighted subpanel is separated from adjacent subpanels of the array by a sewn, stitched, or bonded border.

Embodiment 6: An embodiment of any of the embodiments of embodiment 1-5, wherein the array of weighted subpanels is coextensive with at least 90% of the front panel outer surface.

Embodiment 7: An embodiment of any of the embodiments of embodiment 1-6, wherein the weights of the weighted subpanels are substantially equal.

Embodiment 8: An embodiment of any of the embodiments of embodiment 1-7, wherein the weights of the weighted subpanels located in an abdominal region of the garment are greater than the weights of the weighted subpanels located outside of the abdominal region.

Embodiment 9: An embodiment of any of the embodiments of embodiment 1-8, wherein the weighted subpanels each independently have a weight between 0.5 ounces and 4 ounces.

Embodiment 10: An embodiment of any of the embodiments of embodiment 1-9, having a weight between 0.5 pounds and 2.5 pounds.

Embodiment 11: An embodiment of any of the embodiments of embodiment 1-10, wherein the array of weighted subpanels has a checkerboard or tiled diamond configuration.

Embodiment 12: An embodiment of any of the embodiments of embodiment 1-11, wherein each weighted subpanel independently has a width between 0.5 inches and 1.5 inches.

Embodiment 13: An embodiment of any of the embodiments of embodiment 1-12, wherein the front panel further comprises a zippered opening extending downward from the garment neck opening.

Embodiment 14: An embodiment of embodiment 13, wherein the zippered opening comprises a two-way dual zipper.

Embodiment 15: An embodiment of embodiment 13 or 14, wherein the front panel further comprises a flap configured to conceal at least a portion of the zippered opening.

Embodiment 16: An embodiment of embodiment 15, wherein at least a portion of the flap comprises a fabric face opposite the zippered opening, and wherein at least a portion of the fabric face comprises loops configured for a hook and loop fastening system.

Embodiment 17: An embodiment of any of the embodiments of embodiment 1-16, wherein the front panel comprises a multi-layer construction comprising: a fabric layer forming the front panel outer surface; a breathable layer forming a front panel inner surface opposite the front panel outer surface; and one or more padding layers between the fabric layer and the breathable layer.

Embodiment 18: An embodiment of embodiment 17, wherein the array of weighted subpanels is between two layers of the multi-layer construction.

Embodiment 19: An embodiment of any of the embodiments of embodiment 1-18, wherein the garment includes no arm openings.

Embodiment 20: An embodiment of any of the embodiments of embodiment 1-18, wherein the garment further includes arm openings.

Embodiment 21: An embodiment of any of the embodiments of embodiment 1-20, wherein the garment further includes one or more wings.

Embodiment 22: An embodiment of embodiment 21, wherein the garment comprises at least a portion of each of the one or more wings comprises hooks configured for a hook and loop fastening system.

Embodiment 23: An embodiment of embodiment 21 or 22, wherein the one or more wings are replaceably detachable from the garment.

Embodiment 24: An embodiment of any of the embodiments of embodiment 1-23, wherein the bottom of the garment is enclosed to form a leg pouch.

Embodiment 25: An embodiment of any of the embodiments of embodiment 1-24, wherein the garment further includes two arm sleeves.

Embodiment 26: An embodiment of embodiment 25, wherein the array of weighted subpanels is coextensive with and connected to at least a portion of each of the two arm sleeves.

Embodiment 27: A method of adjusting the distribution of weight in the wearable weighted blanket of an embodiment of any of the embodiments of embodiment 2-4, the method comprising: removing a first pouch from a first weighted subpanel of the array; removing a second pouch from a second weighted subpanel of the array; placing the first pouch in the second weighted subpanel; and placing the second pouch in the first weighted subpanel.

Embodiment 28: A wearable weighted blanket having the form of a garment including a neck opening, the blanket comprising: a front panel comprising an outer surface; and a network of a plurality of weighted braids, wherein the network is coextensive with and connected to at least a portion of the front panel outer surface.

Embodiment 29: An embodiment of embodiment 28, wherein each weighted subpanel comprises a hollow member independently holding a weighted material.

Embodiment 30: An embodiment of embodiment 29, wherein the weighted material comprises glass beads, plastic beads, a polymeric gel, silicone, or a combination thereof.

Embodiment 31: An embodiment of any of the embodiments of embodiment 28-30, wherein the network of weighted braids is coextensive with at least 90% of the front panel outer surface.

Embodiment 32: An embodiment of any of the embodiments of embodiment 28-31, having a weight between 0.5 pounds and 2.5 pounds.

Embodiment 33: An embodiment of any of the embodiments of embodiment 28-32, wherein the weights of the weighted braids are substantially equal.

Embodiment 34: An embodiment of any of the embodiments of embodiment 28-33, wherein the weights of the weighted braids located in an abdominal region of the garment are greater than the weights of the weighted braids located outside of the abdominal region.

Embodiment 35: An embodiment of any of the embodiments of embodiment 28-34, wherein the front panel further comprises a zippered opening extending downward from the garment neck opening.

Embodiment 36: An embodiment of embodiment 35, wherein the zippered opening comprises a two-way dual zipper.

Embodiment 37: An embodiment of embodiment 35 or 36, wherein the front panel further comprises a flap configured to conceal at least a portion of the zippered opening.

Embodiment 38: An embodiment of embodiment 37, wherein at least a portion of the flap comprises a fabric face opposite the zippered opening, and wherein at least a portion of the fabric face comprises loops configured for a hook and loop fastening system.

Embodiment 39: An embodiment of any of the embodiments of embodiment 28-38, wherein the front panel comprises a multi-layer construction comprising: a fabric layer forming the front panel outer surface; a breathable layer forming a front panel inner surface opposite the front panel outer surface; and one or more padding layers between the fabric layer and the breathable layer.

Embodiment 40: An embodiment of embodiment 39, wherein the network of weighted braids is between two layers of the multi-layer construction.

Embodiment 41: An embodiment of any of the embodiments of embodiment 28-40, wherein the garment includes no arm openings.

Embodiment 42: An embodiment of any of the embodiments of embodiment 28-40, wherein the garment includes arm openings.

Embodiment 43: An embodiment of any of the embodiments of embodiment 28-41, wherein the garment includes one or more wings.

Embodiment 44: An embodiment of embodiment 43, wherein at least a portion of each of the one or more wings comprises hooks configured for a hook and loop fastening system.

Embodiment 45: An embodiment of embodiment 43 or 44, wherein the one or more wings are replaceably detachable from the garment.

Embodiment 46: An embodiment of any of the embodiments of embodiment 28-45, wherein the bottom of the garment is enclosed to form a leg pouch.

Embodiment 47: An embodiment of any of the embodiments of embodiment 28-46, wherein the garment further includes two arm sleeves.

Embodiment 48: An embodiment of embodiment 47, wherein the array of weighted subpanels is coextensive with and connected to at least a portion of each of the two arm sleeves.

Embodiment 49: A method of applying pressure to the body of a child, the method comprising: placing the child inside a wearable weighted blanket having the form of a garment including a neck opening, such that the head of the child protrudes out of the garment through the neck opening, the blanket comprising: a front panel comprising an outer surface; and an array of a plurality of weighted subpanels, wherein the array is coextensive with and connected to at least a portion of the front panel outer surface, thereby applying pressure to the body of the child.

Embodiment 50: An embodiment of embodiment 49, wherein the child is an infant having an age of less than 6 years.

Embodiment 51: An embodiment of embodiment 49, wherein the child is an infant having an age of less than 3 months It is understood that the examples and embodiments described herein are for illustrative purposes only and that various modifications or changes in light thereof will be suggested to persons skilled in the art and are to be included within the spirit and purview of this application.

All publications, patents, and patent applications, websites, and databases cited herein are hereby incorporated by reference in their entireties for all purposes. Where a conflict exists between the instant application and a reference provided herein, the instant application shall dominate.

What is claimed is:

1. A wearable weighted blanket having the form of a garment including a neck opening, the wearable weighted blanket comprising:

a front panel comprising:

an outer surface;

a zippered opening extending downward from the neck opening; and a flap configured to conceal at least a portion of the zippered opening, wherein at least a portion of the flap comprises a fabric face that faces away from the zippered opening when the flap is in a position to conceal at least the portion of the zippered opening;

a plurality of weighted subpanels, wherein weighted subpanels of the plurality of weighted subpanels are arranged adjacent to one another to form an array of adjacent weighted subpanels, wherein the array of adjacent weighted subpanels is coextensive with all of the front panel, wherein each weighted subpanel of the plurality of weighted subpanels comprises a pouch independently holding a weighted material, and wherein a sewn, a stitched, or a bonded border separates adjacent weighted subpanels of the plurality of weighted subpanels arranged in the array of adjacent weighted subpanels;

one or more wings attached to a back surface of the wearable weighted blanket; and a hook and loop fastening system comprising:

loops or hooks positioned on a majority of a vertical length of the fabric face of the flap that faces away from the zippered opening when the flap is in the position to conceal at least the portion of the zippered opening; and corresponding loops or hooks positioned on the one or more wings, wherein the wearable weighted blanket comprises a closed configuration in which (i) the one or more wings wrap across a front surface of the wearable weighted blanket and (ii) the corresponding loops or hooks positioned on the one or more wings fasten to the loops or hooks positioned on the majority of the vertical length of the fabric face of the flap that faces away from the zippered opening when the flap is in the position to conceal at least the portion of the zippered opening.

2. The blanket of claim 1, wherein the weighted material comprises glass beads, plastic beads, a polymeric gel, silicone, or a combination thereof.

3. The blanket of claim 1, wherein at least some of the weighted subpanels of the plurality of weighted subpanels comprise equal weights.

4. The blanket of claim 1, wherein weights of the weighted subpanels of the plurality of weighted subpanels located in an abdominal region of the front panel are greater than the weights of the weighted subpanels of the plurality of weighted subpanels located outside of the abdominal region of the front panel.

5. The blanket of claim 1, wherein the weighted subpanels each independently have a weight between 0.5 ounces and 4 ounces.

6. The blanket of claim 1, wherein the blanket is configured to be worn by an infant, and wherein the blanket has a total weight between 0.5 pounds and 2.5 pounds.

7. The blanket of claim 1, wherein the array of adjacent weighted subpanels has a checkerboard or tiled diamond configuration.

8. The blanket of claim 1, wherein at least some of the weighted subpanels of the plurality of weighted subpanels independently have a width between 0.5 inches and 1.5 inches.

9. The blanket of claim 1, wherein the zippered opening comprises a two-way dual zipper.

10. The blanket of claim 1, wherein the front panel comprises a multi-layer construction comprising:

a fabric layer forming the front panel outer surface;

a breathable layer forming a front panel inner surface opposite the front panel outer surface; and one or more padding layers between the fabric layer and the breathable layer.

11. The blanket of claim 1, wherein the garment further includes arm openings.

12. The blanket of claim 1, wherein the one or more wings are replaceably detachable from the garment.

13. The blanket of claim 1, wherein a bottom of the garment is enclosed to form a leg pouch.

14. The blanket of claim 1, wherein:

the one or more wings comprise a first wing and a second wing, the corresponding loops or hooks are positioned on a front surface of the first wing, the first wing further comprises loops positioned on a back surface of the first wing, and the closed configuration of the wearable weighted blanket comprises the second wing securing to the first wing via the loops on the back surface of the first wing.

* * * * *